US011548687B2

(12) United States Patent
Kusogullari et al.

(10) Patent No.: US 11,548,687 B2
(45) Date of Patent: Jan. 10, 2023

(54) TRANSPORT UNIT AND PACKAGING STRUCTURE FOR TRANSPORTING AND STORING A PLURALITY OF CONTAINERS FOR SUBSTANCES FOR PHARMACEUTICAL, MEDICAL OR COSMETIC USES

(71) Applicant: SCHOTT Schweiz AG, St. Gallen (CH)

(72) Inventors: Levent Kusogullari, Schönenberg an der Thur (CH); David Hilber, Uzwil (CH)

(73) Assignee: Schott Schweiz AG, St. Gallen (CH)

( * ) Notice: Subject to any disclaimer, the term of this patent is extended or adjusted under 35 U.S.C. 154(b) by 193 days.

(21) Appl. No.: 16/670,393

(22) Filed: Oct. 31, 2019

(65) Prior Publication Data

US 2020/0130894 A1 Apr. 30, 2020

(30) Foreign Application Priority Data

Oct. 31, 2018 (DE) ..... 10 2018 127 191.3

(51) Int. Cl.
*B65D 25/10* (2006.01)
*A61J 1/16* (2006.01)
*B65D 77/20* (2006.01)

(52) U.S. Cl.
CPC ..... *B65D 25/108* (2013.01); *A61J 1/16* (2013.01); *B65D 77/2024* (2013.01)

(58) Field of Classification Search
CPC .. B65D 25/108; B65D 25/10; B65D 77/2024; A61J 1/16
(Continued)

(56) References Cited

U.S. PATENT DOCUMENTS 4,549,656 A * 10/1985 Barnes ..... B65D 81/022 206/443
5,456,360 A 10/1995 Griffin
(Continued)

FOREIGN PATENT DOCUMENTS

DE 10 2012 103 899 A1 11/2013
DE 10 2014 112 357 A1 3/2016
(Continued)

OTHER PUBLICATIONS

German Office Action dated Jul. 5, 2019 for German Application No. 10 2018 127 191.3 (7 pages).
(Continued)

*Primary Examiner* — Steven A. Reynolds
(74) *Attorney, Agent, or Firm* — Taylor IP, P.C.

(57) ABSTRACT

A transport unit for a packaging structure for a plurality of containers for substances for pharmaceutical, medical or cosmetic uses includes a tray with a plurality of seats for positioning the containers and a planar inlay part for covering the containers positioned in the seats of the tray. The inlay part is configured to cover the containers positioned in the seats and at the same time to be received completely in the tray, without protruding above an upper edge of the tray. A plurality of depressions corresponding to the seats of the tray are formed in the inlay part, in order to position the containers at their two ends lying opposite each other. A gap is formed at least partially between the inlay part, received in the tray, and side walls of the tray.

19 Claims, 9 Drawing Sheets

(58) Field of Classification Search
USPC ..... 206/438
See application file for complete search history.

(56) References Cited

U.S. PATENT DOCUMENTS

| | | | | |
|---|---|---|---|---|
| 8,360,238 | B2 | 1/2013 | Nicoletti | |
| D690,028 | S | 9/2013 | Tsukiji | |
| D701,617 | S | 3/2014 | Tsukiji | |
| 10,434,242 | B2 | 10/2019 | Thompson et al. | |
| 2002/0093147 | A1 | 7/2002 | Berna et al. | |
| 2012/0181285 | A1* | 7/2012 | Krauss | A61J 1/16 220/507 |
| 2013/0161225 | A1* | 6/2013 | Lepot | A61M 5/008 206/557 |
| 2013/0186793 | A1* | 7/2013 | Gagnieux | A61M 5/002 206/364 |
| 2015/0114871 | A1* | 4/2015 | Fitzpatrick | B65G 57/02 206/508 |
| 2017/0073091 | A1 | 3/2017 | Deutschle et al. | |

FOREIGN PATENT DOCUMENTS

| | | | |
|---|---|---|---|
| EP | 2 915 516 | A1 | 9/2015 |
| EP | 2 867 130 | B | 8/2017 |
| WO | 2013/034737 | A1 | 3/2013 |
| WO | 2013/181552 | A2 | 12/2013 |
| WO | 2016/166769 | A1 | 10/2016 |

OTHER PUBLICATIONS

European Office Action dated Feb. 25, 2021 for European Patent Application No. 19 206 042.2 (4 pages).
European Office Action dated Oct. 18, 2021 for European Patent Application No. 19 206 042.4 (4 pages).
Chinese Office Action dated Jul. 8, 2022 for Chinese Patent Application No. 201911050535.9 (8 pages).
English translation of Chinese Office Action dated Jul. 8, 2022 for Chinese Patent Application No. 201911050535.9 (9 pages).
India Office Action, including an English translation, dated Aug. 23, 2022 for India Patent Application No. 201914043698 (5 page).

* cited by examiner

TRANSPORT UNIT AND PACKAGING STRUCTURE FOR TRANSPORTING AND STORING A PLURALITY OF CONTAINERS FOR SUBSTANCES FOR PHARMACEUTICAL, MEDICAL OR COSMETIC USES

BACKGROUND OF THE INVENTION

1. Field of the Invention

The present invention relates generally to the treatment of containers for substances for pharmaceutical, medical or cosmetic uses and relates in particular to transport units for transporting and/or storing a plurality of containers for substances for pharmaceutical, medical or cosmetic uses, for example vials, ampoules or carpoules. The present invention further relates to a packaging structure with such a transport unit, in particular for transporting and/or storing the containers packed therein under sterile conditions.

2. Description of the Related Art

Medicament containers, for example vials, ampoules or carpoules, are widely used as containers for storing medical, pharmaceutical or cosmetic preparations for administration in liquid form, in particular in pre-dosed quantities. These medicament containers generally have a cylindrical shape, can be produced from plastics or from glass and can be obtained cost-effectively in large numbers. The containers are increasingly being delivered in holding structures to a pharmaceuticals manufacturer or to a subsequent processing operation and are further processed while the containers in the holding structure are held or received in a predetermined geometric arrangement and at precisely defined positions. For this purpose, cost-effective and durable holding structures are needed in which the containers are held or received in an arrangement that takes up the least possible space.

As alternatives to such holding structures of a comparatively complicated design, transport units are also known in which the containers are transported and/or stored in a regular arrangement, i.e. at predetermined positions, under sterile or also non-sterile conditions. Such transport units can be made available by simple production methods, in particular by deep-drawing or thermoforming from thin plastic sheets or plastic films. Such transport units usually have seats for receiving the containers at predetermined positions, wherein guiding portions are intended to assist in inserting the containers into the seats, and positioning portions are provided for precise positioning of the containers. However, it is difficult to achieve very high packing densities.

EP 2 915 516 A1 discloses a tray for vials, which tray is produced by deep-drawing from thermoplastic material. The seats of the tray have a tapered shape and, in order to position the vials, are adapted precisely to the outer contour of the vials, which is complicated. A step in the upper third of the seats provides support for shoulder portions of the vials that are received upside down, such that their filling openings are not closed by the base of the seats. The lower ends of the vials protrude above the upper edge of the tray, such that sterile transport of the vials is not easily possible.

Comparable trays are disclosed in the U.S. design Pats. D701,617 S and D690,028 S.

US 2002/0093147 A1 discloses a holding tablet for syringe bodies or carpoules which are hooked in openings of the holding tablet. Several holding tablets can be stacked on top of one another. To close them off from the environment, a tray with depressions is provided. This tray can be provided both on the underside and on the top of the holding tablet. However, sterile packaging of the syringe bodies or carpoules is not possible.

EP 2 867 130 B1 discloses a packaging unit for vials, which consists of two interconnected trays that each have seats for positioning the lower and upper ends of the vials received in them. To remove individual vials, a side wall can be opened and closed again. However, sterile packaging of the vials is not possible.

WO 2013/181552 A2 discloses a tray for vials into which either a cover for the transport of the vials or a cover for the further processing of the vials can be clipped. For transport of the vials under sterile conditions, a gas-permeable film is affixed to the transport cover, wherein openings are provided on the transport cover and a continuous flow path is ensured, such that the vials received in the seats of the tray can be sterilized, both on their outside and on their inside, by a gas flowing in through the gas-permeable film into the tray.

US 2017/0073091 A1 discloses further transport units for vials, which transport units consist of two box-shaped packaging parts nesting one inside the other. The vials stand upright on the base of the lower packaging part. To prevent contaminants from entering the vials via their filling openings when opening the transport unit, an inlay part is placed onto the upper ends of the vials. This transport unit permits a very high packing density of the vials and simple transfer to processing stations for further processing of the vials. However, the vials touch each other directly, which can lead to unwanted abrasion and scratches, and also to contaminants arising inside the transport structure.

SUMMARY OF THE INVENTION

Exemplary embodiments disclosed herein provide an improved transport unit and a packaging structure for a plurality of containers for substances for pharmaceutical, medical or cosmetic uses, which packaging structure can be produced easily and cost-effectively, is intended to permit a very high packing density, with at the same time precise positioning and centering of the containers, and is also intended to be equally suitable for transport and storage of the containers under sterile conditions.

In some exemplary embodiments provided according to the present invention, a transport unit for a packaging structure for a plurality of containers for substances for pharmaceutical, medical or cosmetic uses includes: a tray with a plurality of seats configured to position containers; and a planar inlay part configured to cover the containers positioned in the seats of the tray and at the same time to be received completely in the tray without protruding above an upper edge of the tray, the inlay part having a plurality of depressions corresponding to the seats of the tray formed therein, in order to position the containers at their two ends lying opposite each other, wherein a gap is formed at least partially between the inlay part received in the tray and side walls of the tray.

In some exemplary embodiments provided according to the present invention, a packaging structure for containers for substances for pharmaceutical, medical or cosmetic uses includes: a transport unit holding a plurality of containers. The transport unit includes: a tray with a plurality of seats in which the containers are positioned, the containers being received upside down in the seats of the tray; and a planar inlay part configured to cover the containers positioned in the seats of the tray, the inlay part being configured to cover the containers positioned in the seats and at the same time to be received completely in the tray without protruding above an upper edge of the tray, the inlay part having a plurality of depressions corresponding to the seats of the tray formed therein, in order to position the containers at their two ends lying opposite each other. A gap is formed at least partially between the inlay part received in the tray and side walls of the tray, the inlay part bearing on the containers positioned in the seats in such a way that a narrow gap is formed at least partially between the inlay part and side walls of the tray. A cover is connected to an upper edge of the tray, the cover sealing off an inner volume of the packaging structure from the environment.

Sterile packaging of the containers can be realized in a simple way by affixing a cover film with the properties of a sterile barrier to the upper edge of the tray. This cover film may be formed to be gas-permeable or vapor-permeable at least in one portion, in order to allow the whole interior of the packaging structure and the containers received therein to be sterilized by a gas or vapor flowing in through the cover film. The gap formed at least partially between the inlay part, received in the tray, and side walls of the tray ensures that the gas or the vapor for sterilizing the containers can flow unimpeded into the space between the inlay part and the seats of the tray.

The containers are received upside down in the seats of the tray. The upper ends of the containers are supported at a distance from the base of the seats, such that a continuous flow path of gas is realized from the aforementioned space, between the inlay part and the seats of the tray, as far as the filling openings of the containers. Thus, the containers can be sterilized by inflowing gas or inflowing vapor, not only on their outside but also on their inside, while they are received in the packaging structure.

The simple geometry of tray and inlay part permits a very high packing density along with a simple and cost-effective design.

Even if the side walls of the seats extend obliquely and radially inwards, the seats can be arranged very close to one another according to the present invention, because they do not need to extend, according to the present invention, over the full height of the tray, and instead it is sufficient if they are formed with only a comparatively short height in the lower region of the tray. However, through the interaction of the seats of the tray with the depressions of the inlay part, very precise and stable positioning of the containers at their two ends can still be achieved when they are received in the tray. According to the present invention, the containers can be held substantially immovably between the seats of the tray and the depressions of the inlay part.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 2A:
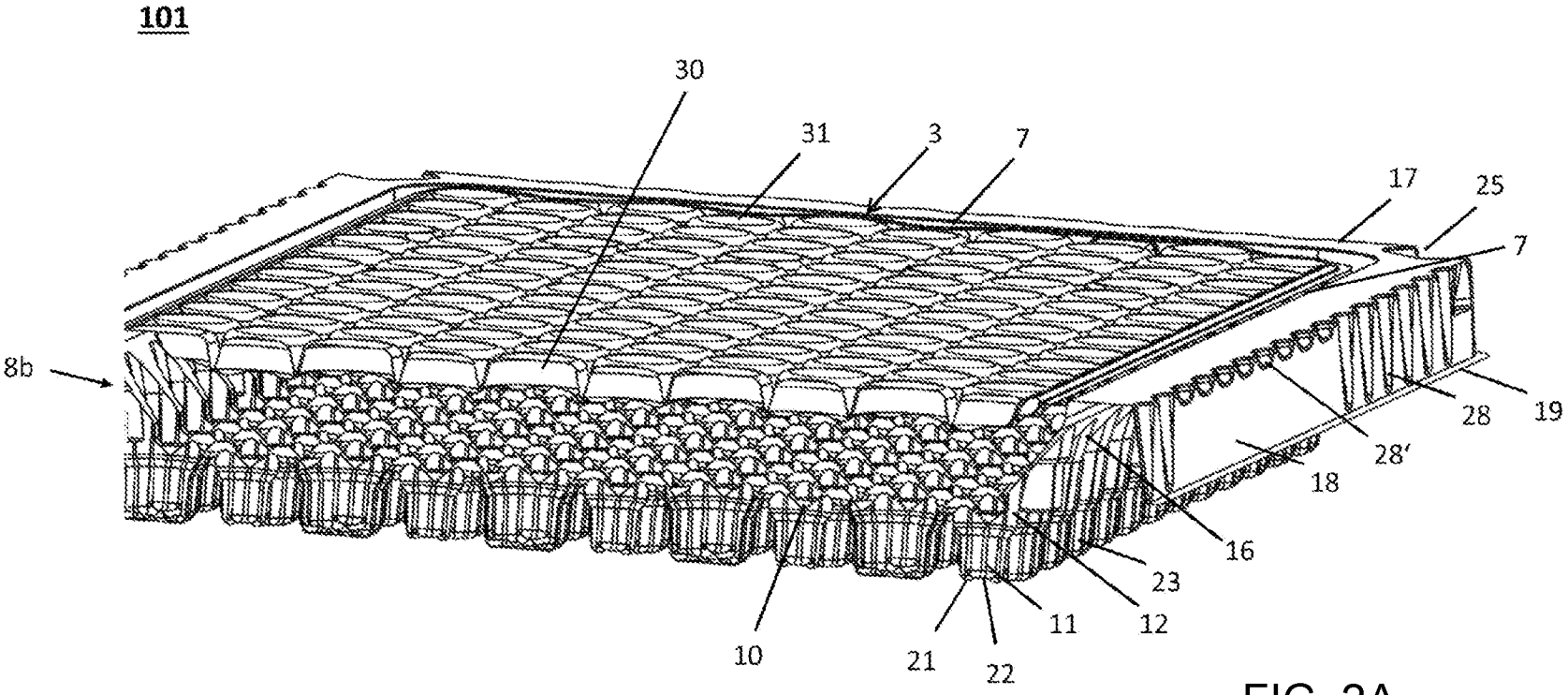
FIG. 2A illustrates a perspective partial section of a transport unit of FIG. 1A, without containers received therein.
Figure 2B:
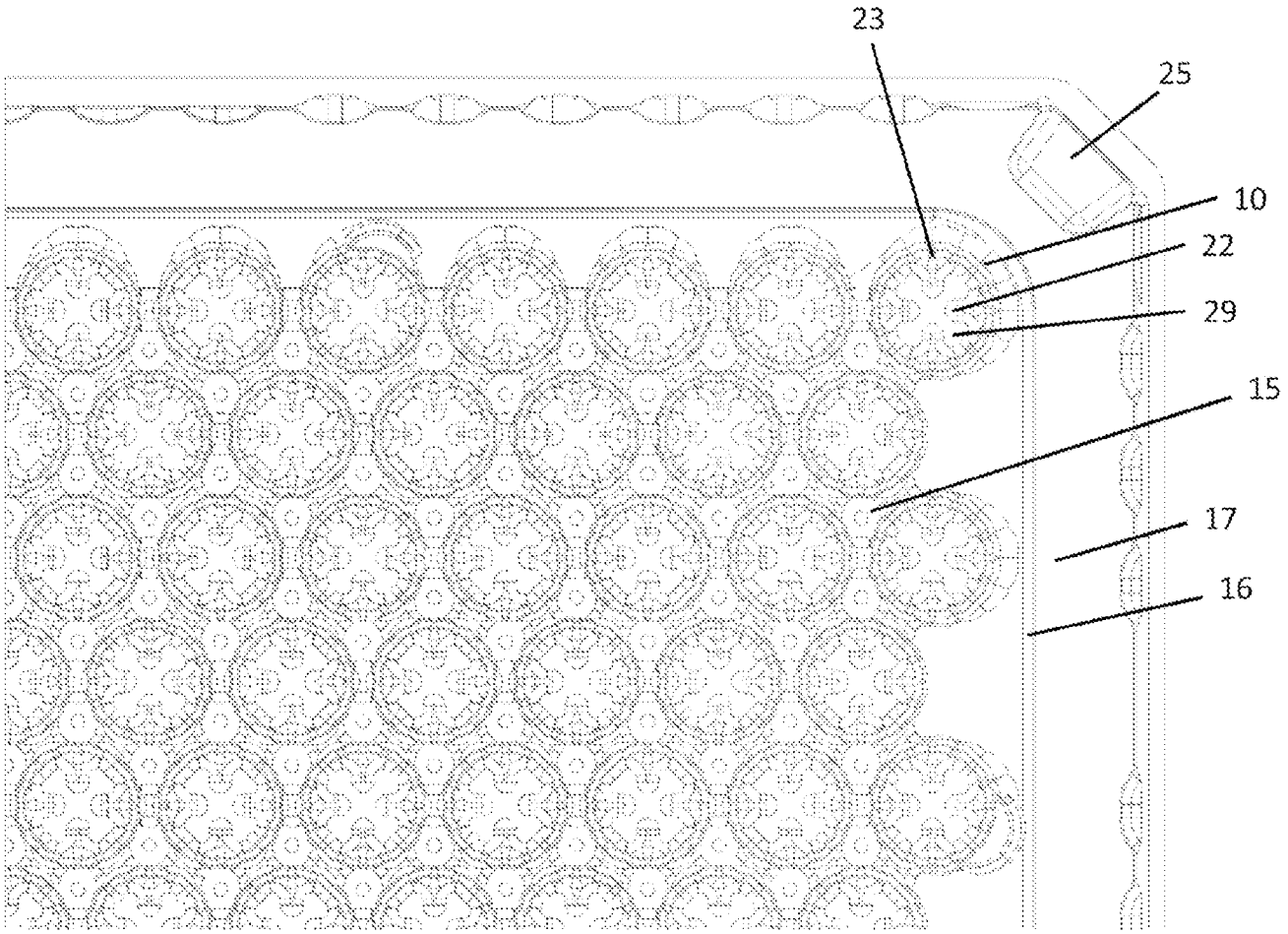
FIG. 2B illustrates an enlarged plan view from above of a cut-out of a tray of the transport unit of FIG. 1A.

Referring now to the drawings, an exemplary embodiment of a packaging structure 100 provided according to the present invention will first of all be described below with reference to FIGS. 2C and 2D. This exemplary embodiment is based on the assumption that vials 60, in particular glass vials, are intended to be transported and stored as containers for substances for pharmaceutical, medical or cosmetic uses. However, the present invention is expressly not intended to be limited to the transport and storage of vials, and instead it can also be used correspondingly for comparable containers, for example for carpoules or syringe bodies.

As is known, vials 60 are formed from a main body with a cylindrical side wall 62, of which the lower end is formed by a closed base 63, and of which the upper end is formed by a gradually tapering shoulder portion 64, which merges into a narrowed neck portion 65 and a widened upper edge 66 in which a filling opening 67 is formed.

The packaging structure 100 is formed by a tray 1, with a plurality of seats 10 for positioning the vials 60 upside down, and by an inlay part 3 which on the whole has a planar configuration, in the manner of a plate, and which bears directly on the bases 63 of the vials 60 positioned in the seats 10 of the tray 1 or is supported directly on the side walls 16 of the tray 1 and at a slight distance from the bases 63, in order to cover all of the vials 60. The height of the side walls 16 of the tray 1 is adapted to the lengths of the vials 60 to be received, such that the inlay part 3 does not protrude above the upper edge 17 of the tray 1 so that the inlay part 3 is received completely in the tray 1. At the upper edge 17, a cover 5 is connected to the tray 1. The cover 5 can be formed as a plane, gas-impermeable plastic sheet, which can also be provided with at least one gas-permeable or vapor-permeable portion in order to allow the inflow of a gas or a vapor for sterilizing the interior of the packaging structure 100 with the containers 60 received therein, as is described below. The cover may be a thin, flexible, gas-permeable or vapor-permeable plastic film, in particular formed by a braiding of plastic fibers, for example polypropylene (PP) fibers, which is affixed to the flange-like circumferential upper edge 17 of the tray 1 by an adhesive edge 51. Plastic films 5 of this kind are available in particular under the trade name Tyvek®.

At the base of the tray 1, a plurality of frustoconical seats 10 are formed, which are each formed by circumferential side walls 11, 12, between which a beveled connecting region 13 is formed, which can serve as an insertion bevel when inserting the containers 60 vertically from above. The upper ends of the vials 60, arranged vertically and upside down, are received in these seats 10. In some embodiments, the shoulder portions 64 or cylindrical side walls 62 of the vials 60 are received with slight radial play. In some embodiments, the radial play is in the range of 0.5 mm to 15 mm, such as in the range of 2.5 mm to 13 mm or in the range of 4 mm to 10. As will be seen from FIG. 2C, the axial length z3 of these seats 10 is less than the axial length of the containers 60, such that a free space 8*b* is formed in a central height region between the seats 10 of the tray 1 and the inlay part 3, said free space 8*b* being free of guiding or positioning devices for guiding or positioning the containers 60. The height of this free space 8*b* corresponds to at least 40% of the overall height of the tray 1, such as at least 50% of the overall height of the tray 1.

To be more exact, the seats 10 each comprise lower seats, which are formed by a circumferential lower side wall 11 and a closed base 21, and also a frustoconical region, which is formed by circumferential upper side walls 12. The upper ends of the containers 60 are received in the lower seats, while the shoulder portions 64 of the container 60 are received in the upper seats. The height z1 of the lower seats is slightly greater than the axial length of the widened upper edges 66 of the vials. The lower seats merge into the upper seat regions approximately in the region of the narrowed neck portions 65.

A minimum diameter of the lower seats is slightly greater than a maximum external diameter at the upper end 66 of the containers 60 to be received, in order to prevent the upper ends 66 from becoming jammed in the seats 10 of the tray 1. In some embodiments, the minimum diameter of the seats 10 of the tray 1 is in the range of 0.5 mm to 15 mm, such as in the range of 2.5 mm to 13 mm or in the range of 4 mm to 10 mm, greater than the maximum external diameter at the upper end 66 of the containers 60 that are to be received. When the lower side walls 11 are provided with axial ribs, as is described in more detail below, the minimum diameter of the lower seats can also be equal to, or substantially correspond to, the maximum external diameter at the upper end 66 of the containers 60 that are to be received. The shape of the seat regions formed by the circumferential upper side walls 12 is adapted to the outer contour of the containers 60 to be received, such that jamming of the containers 60 on the upper side walls 12 is likewise prevented.

Figure 2C:
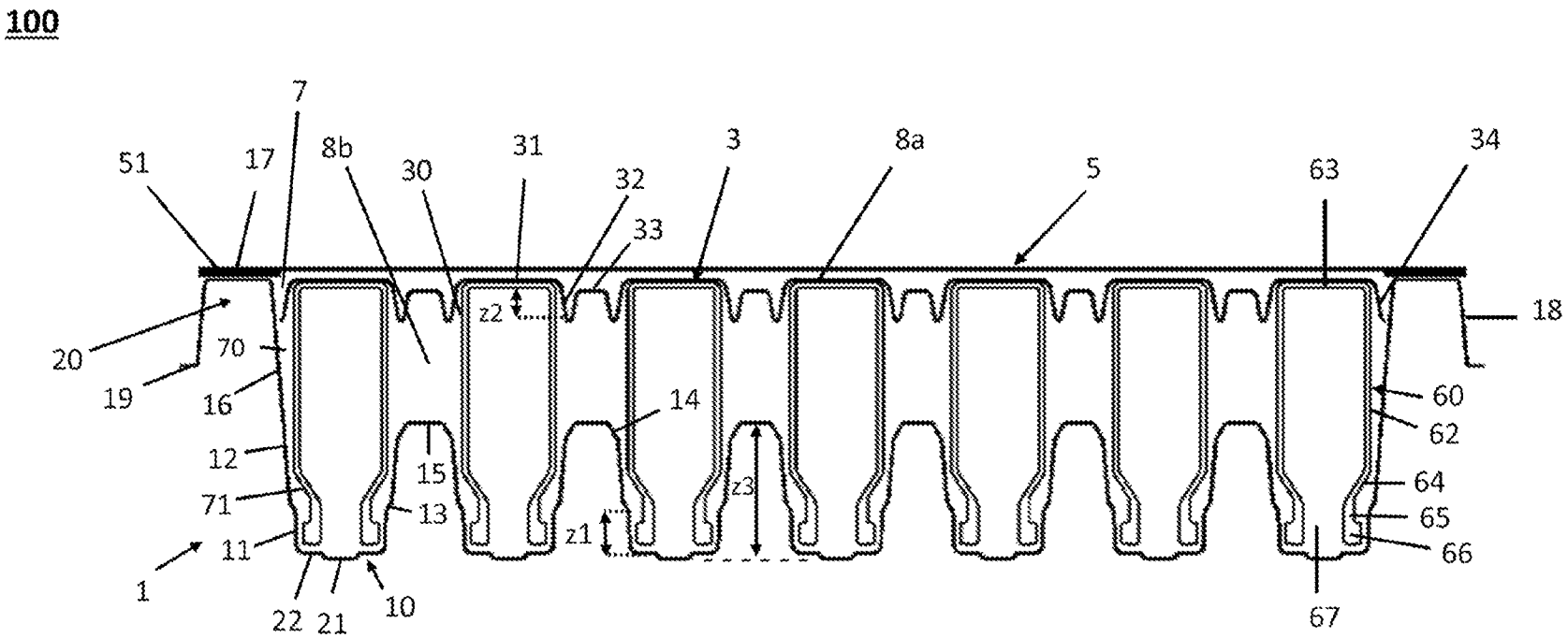
FIG. 2C illustrates a schematic cross-sectional view of an exemplary embodiment of a packaging structure provided according to the present invention, with containers in the form of vials received therein.
Figure 2D:
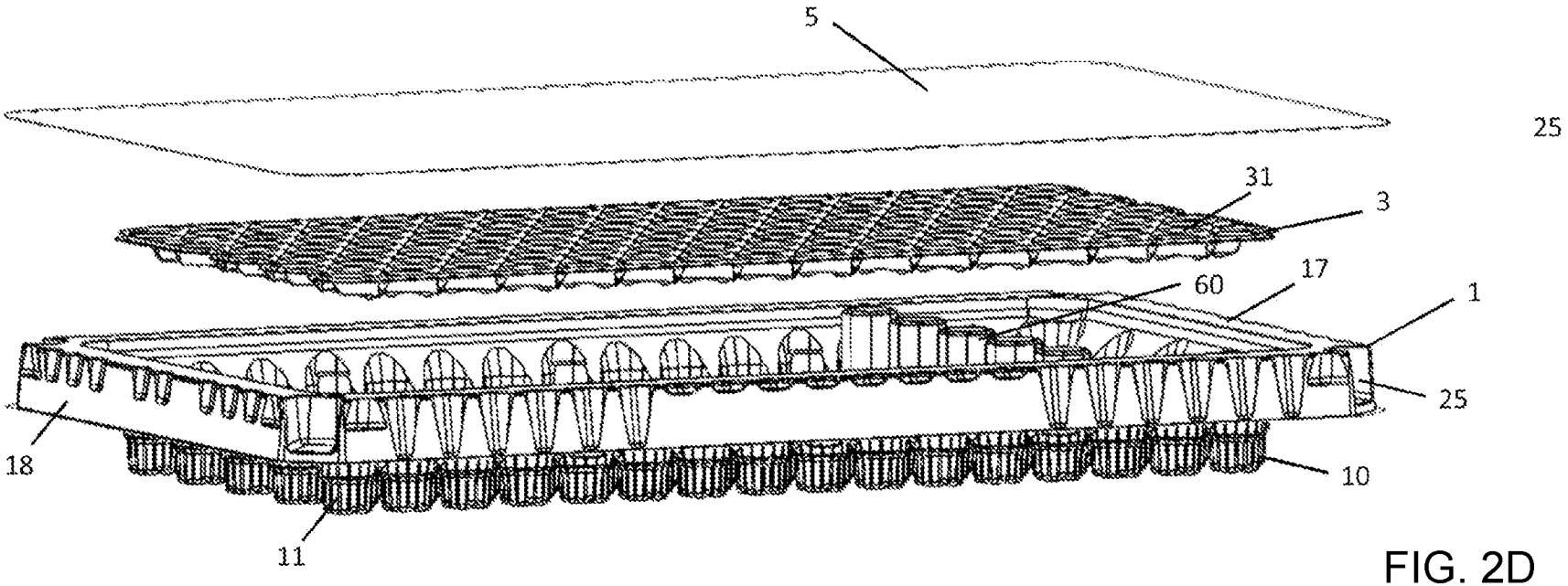
FIG. 2D illustrates a perspective exploded view of the packaging structure of FIG. 2C.

According to FIG. 2C, the seats 10 are connected to one another via flat connecting portions 15 which collectively lie in one plane. The upper ends of the upper side walls 12 are provided with insertion bevels 14 in order to guide the containers 60 when the latter are inserted vertically from above into the seats 10.

For reasons of simplification, FIG. 2C shows that a gap is formed between the base 21 of the seats 10 and the upper edge 66 of the containers 60. However, as can be seen from the plan view of the seats 10 in FIG. 2B, several bearing webs 22 spaced apart from each other are formed on the base 21 of the seats 10, protrude vertically from the base 21 and extend radially inwards into the seats 10, but without touching at the center of the seats 10. A depression is thus formed at the center of the seats 10. The spaces 29 between the bearing webs 22 are continuously connected to this depression at the center of the seats 10. When the containers 60 are inserted upside down into the seats 10, the containers 60 thus lie with their upper edges 66 on the bearing webs 22, wherein the filling openings 67 are not closed by the base 21. Instead, a continuous gas flow path is formed from the gap 71 between the narrowed neck portions 65 and the side walls 11 to the filling openings 67, the gas flow path running via gaps between the widened upper edge 66 and the lower side wall 11 and via the spaces 29 (cf. FIG. 2B), formed between the bearing webs 22, to the base 21 of the seats 10 and to the filling opening 67. In the case where the lower side walls 11 are provided with axial ribs, as is explained in more detail below, these gaps between the widened upper edge 66 and the lower side wall 11 can be formed directly by spaces between these axial ribs. By contrast, in the case where the lower side walls 11 are smooth and formed without such axial ribs, the minimum diameter of the lower seats formed by the lower side walls 11 is slightly greater than the maximum external diameter of the containers 60 in the region of the widened upper edges 66.

As can be further seen from FIG. 2C, the gap 70 between the cylindrical side walls 62 of the containers 60 and the upper side walls 12 is connected to the gap 71, such that a gas or a vapor flowing through the gap 70 can flow onwards into the gap 71 and thus via the filling openings 67 into the containers 60, for example in order to sterilize the inner volumes of the containers 60 with gas or vapor. In the case where the upper side walls 12 are provided with axial ribs, as is explained in more detail below, these gaps 70 in the region of the upper side walls 12 can be formed directly by spaces between these axial ribs. By contrast, in the case where the upper side walls 12 are smooth and formed without such axal ribs, the diameter of the upper side walls 12 in the region of the shoulder portions 64 or of the cylindrical side walls 62 of the containers 60 is slightly greater than the maximum external diameter of the containers 60 in the region of the shoulder portions 64 or cylindrical side walls 62.

To make it easier to insert the containers 60 into the seats 10 and to avoid jamming of the containers 60 therein, the side walls 11, 12 of the seats 10 run obliquely and radially inwards.

As can be further seen from FIG. 2C, the side walls 16 of the tray 1 merge into a flat frame-like or flange-like upper edge 17 on which the cover 5 sits, in particular on which a cover film 5 is affixed. The upper edge 17 merges into an upper side wall 18 which extends obliquely downwards in the direction of the base of the tray 1 and which is formed circumferentially and, together with the upper end of the side wall 16, forms a U-shaped free space 20, such that the tray 1 can be handled by hooking it with this U-shaped free space 20 into a holding frame (not shown). Such a holding frame can in particular be part of a turning device for turning the tray 1 together with the containers 60 received therein, and together with a turning plate (not shown), such that, after turning, the bases 63 of all of the containers 60 lie on the turning plate and the containers 60 are arranged standing upright, as is described in more detail below with reference to FIG. 3.

The outside of the upper side wall 18 can also be used for labelling or marking the packaging structure by printing or labels or the like. The resulting areas on the upper side wall 18 can also be used for gripping the tray 1 by vacuum cups or the like. This makes it possible for the tray 1 to be removed fully automatically with the aid of suction cups or the like from, for example, a transport bag.

As is shown in FIG. 2C, all the containers 60 are covered by the inlay part 3. The inlay part 3 is designed such that it is received completely inside the tray 1 and such that, above the inlay part 3, a continuous upper free space 8*a* is formed in which a gas or vapor, flowing in through a cover film 5 for example, can flow. For this purpose, it is sufficient if the height of the upper free space 8*a* is relatively small.

As can be seen from FIG. 2C, a plurality of depressions 30 are formed in the inlay part 3, at positions corresponding to the seats 10 of the tray 1, in which depressions 30 the lower ends of the containers 60 are received. For this purpose, it suffices if the depressions 30 are comparatively shallow. For example, the height z2 of the depressions 30 can be only 1 mm or a few mm. In some embodiments, the height z2 is in the range of 0.5 mm to 12.5 mm, such as in the range of 3 mm to 10 mm or in the range of 4.5 mm to 8.5 mm. In order to prevent the lower ends of the containers 60 from becoming jammed in the depressions 30, the circumferential side walls 32 of the seats 30 extend obliquely and radially inwards, wherein a minimum diameter of the seats 30 can be slightly greater than a maximum external diameter of the containers 60 at their lower ends.

In some embodiments, the depressions 30 of the inlay part 3 are formed by circumferential side walls 32, wherein a minimum diameter of the depressions 30 of the inlay part 3 is slightly greater than a maximum external diameter at the lower end 63 of the containers that are to be received, so as to prevent the lower ends of the containers from becoming jammed in the depressions 30 of the inlay part 3. In some embodiments, the minimum diameter of the depressions 30 of the inlay part 3 is in the range of 0.5 mm to 15 mm, such as in the range of 2.5 mm to 13 mm or in the range of 4 mm to 10 mm, greater than the maximum external diameter at the lower end 63 of the containers that are to be received.

The inlay part 3 can bear loosely on the bases 63 of the containers 60. A slight lateral play can be present between the elevated edge 34 of the inlay part 3 and the side walls 16 of the tray 1, such that, between the elevated edge 34 of the inlay part 3 and the side walls 16 of the tray 1, a gap 7 is in each case at least partially formed, through which gap 7 gas or vapor can flow from the upper free space 8*a* into the lower free space 8*b* and then onwards to the upper ends of the containers and into the filling openings 67. In some embodiments, the lateral play is in the range of 0.5 mm to 15 mm, such as in the range of 2.5 mm to 13 mm or in the range of 4 mm to 10 mm. This lateral play can cause a slight lateral movement of the inlay part 3 relative to the side walls 16 of the tray 1, but this play is in any case very much smaller than the diameter of the containers 60 and can amount, for example, to a maximum of 1 mm or a few mm, to reliably prevent a collision of immediately adjacent containers 60.

In some embodiments, the elevated edge 34 of the inlay part 3 can also be supported directly on the side walls 16 of the tray 1 or bear on these side walls 16, such that the inlay part 3 is received immovably and without lateral play in the tray 1. In such a case, at least one indentation or several indentations are provided along the elevated edge 34 of the inlay part 3 and/or the side walls 16 of the tray 1, the indentation connecting the upper free space 8*a* to the lower free space 8*b* such that a gas or vapor can flow unimpeded from the upper free space 8*a* into the lower free space 8*b*. The bases 31 of the depressions 30 do not need to bear directly on the bases 63 of the containers 60, and instead a narrow gap can be formed between these.

As can be seen from FIG. 2C, the lower seats 10 position the upper ends of the containers 60, while the depressions 30 of the inlay part 3 position the opposite, lower ends of the containers 60. Through the cooperation of the seats 10 and the depressions 30, the containers 60 are thus precisely positioned at their two ends. This positioning can reliably prevent a collision of immediately adjacent containers 60 during storage and transport in the tray 1, so that no unwanted particles can form in the tray 1 as a result of such collisions. The positioning of the containers 60 at their two ends can in principle be substantially free of play, such that the containers 60 are held substantially immovably. In principle, however, a certain radial play can be provided at both ends of the containers 60, such that the containers 60 can be held so as to be movable to a slight extent, for example in order to compensate for tolerances or different thermal expansion.

Further details of a transport unit 101 provided according to the present invention are described below with reference to FIGS. 1A to 2B. As can be seen from FIG. 1A, the inlay part 3 is substantially rectangular, corresponding to the inner contour of the side walls 16 of the tray 1. A narrow gap 7 can be formed along the longitudinal sides and connects the upper free space 8*a* to the lower free space 8*b* (cf. FIG. 2C).

Furthermore, the transverse sides of the inlay part 3 have undulating portions in the regions 37, with projections which extend almost or completely to the side wall 16 of the tray 1, and with depressions in the region of which between the side wall 16 and the edge of the inlay part a widened gap 7' of semi-circular contour is formed, which connects the upper free space 8*a* to the lower free space 8*b* (cf. FIG. 2C). An outer contour of the inlay part 3 can be adapted to an inner contour of the tray 1 at its upper edge, such that the inlay part 3 is received loosely and with slight lateral play in the tray 1 when it bears on the containers positioned in the tray 1. In some embodiments, the lateral play is in the range of 0.5 mm to 15 mm, such as in the range of 2.5 mm to 13 mm or in the range of 4 mm to 10 mm. Furthermore, according to FIG. 1B, a straight edge portion 36 is formed along each of the transverse sides of the inlay part 3, wherein a gap 7 is formed between the straight edge portion 36 and the side wall 16 of the tray 1.

However, the straight edge portion 36 along the transverse sides of inlay part 3 is not absolutely necessary. Rather, the undulating portions 37 can also extend over the entire length of the transverse sides of the inlay part 3, as shown in FIG. 1D, a plan view of an exemplary embodiment of a transport structure 101 provided according to the present invention.

Moreover, two corner regions of the inlay part 3 are provided with indentations 38, such that a widened gap is likewise formed between the rounded corner regions 24 of the tray 1 and the inlay part 3 in the region of these indentations 38, which widened gap connects the upper free space 8*a* to the lower free space 8*b* (cf. FIG. 2C). These indentations 38 moreover serve to allow the inlay part 3 to be gripped by hand or by a gripping tool, for example a robot, in the region of the indentations 38, in order to be lifted from the containers and removed, or in order to be inserted into the tray 1 so as to cover the containers. For this purpose, the indentations 38 must be set back to a sufficient extent such that, for example, at least one finger of a human operator can be inserted into the indentations 38.

In some embodiments, the corner regions of the inlay part 3 can in part correspond exactly to the opposite corner regions 24 of the tray 1, such that the inlay part 3 is supported on the side walls 16 of the tray 1 exclusively in these corner regions and is thus received immovably in the tray 1.

Figure 1A:
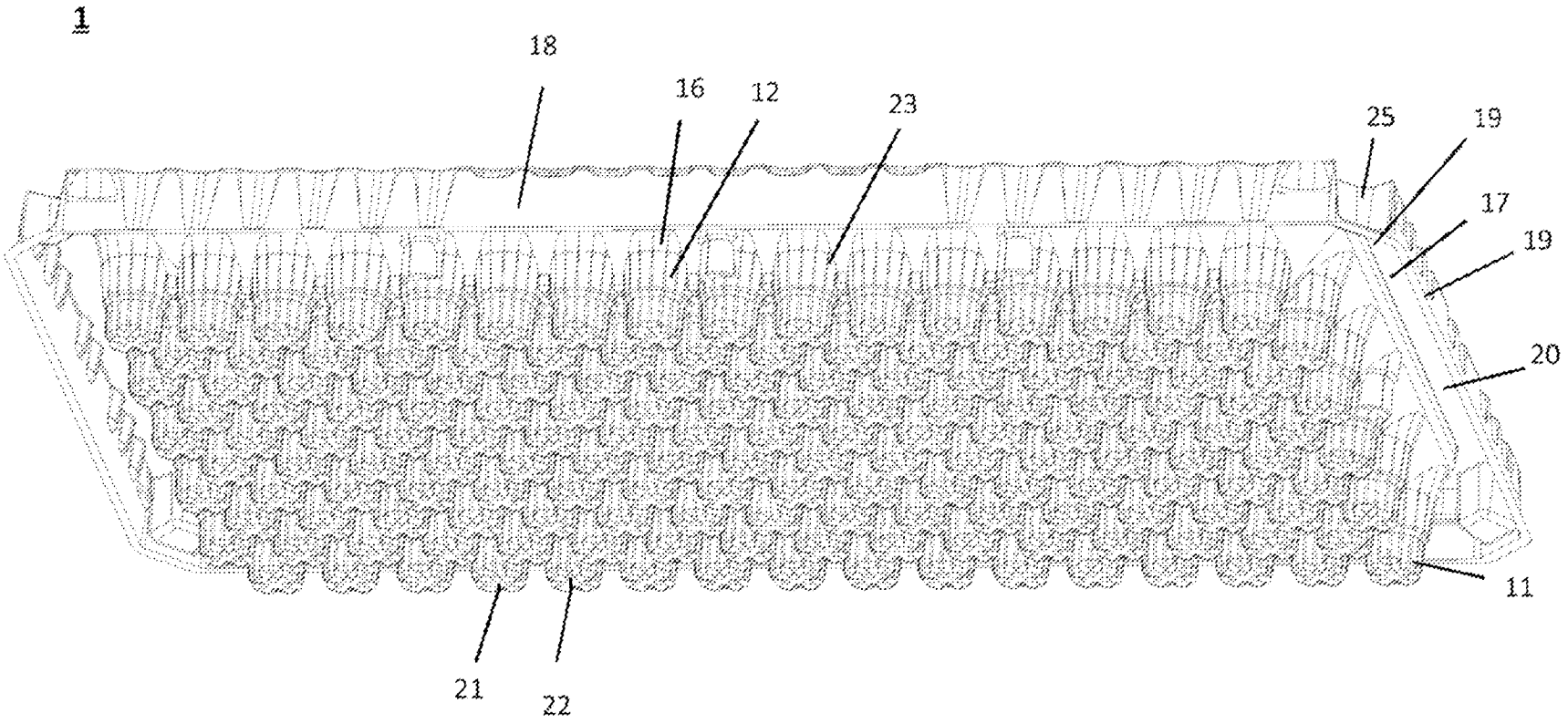
FIG. 1A illustrates a perspective view from below of an exemplary embodiment of a transport unit of a packaging structure provided according to the present invention.
Figure 1B:
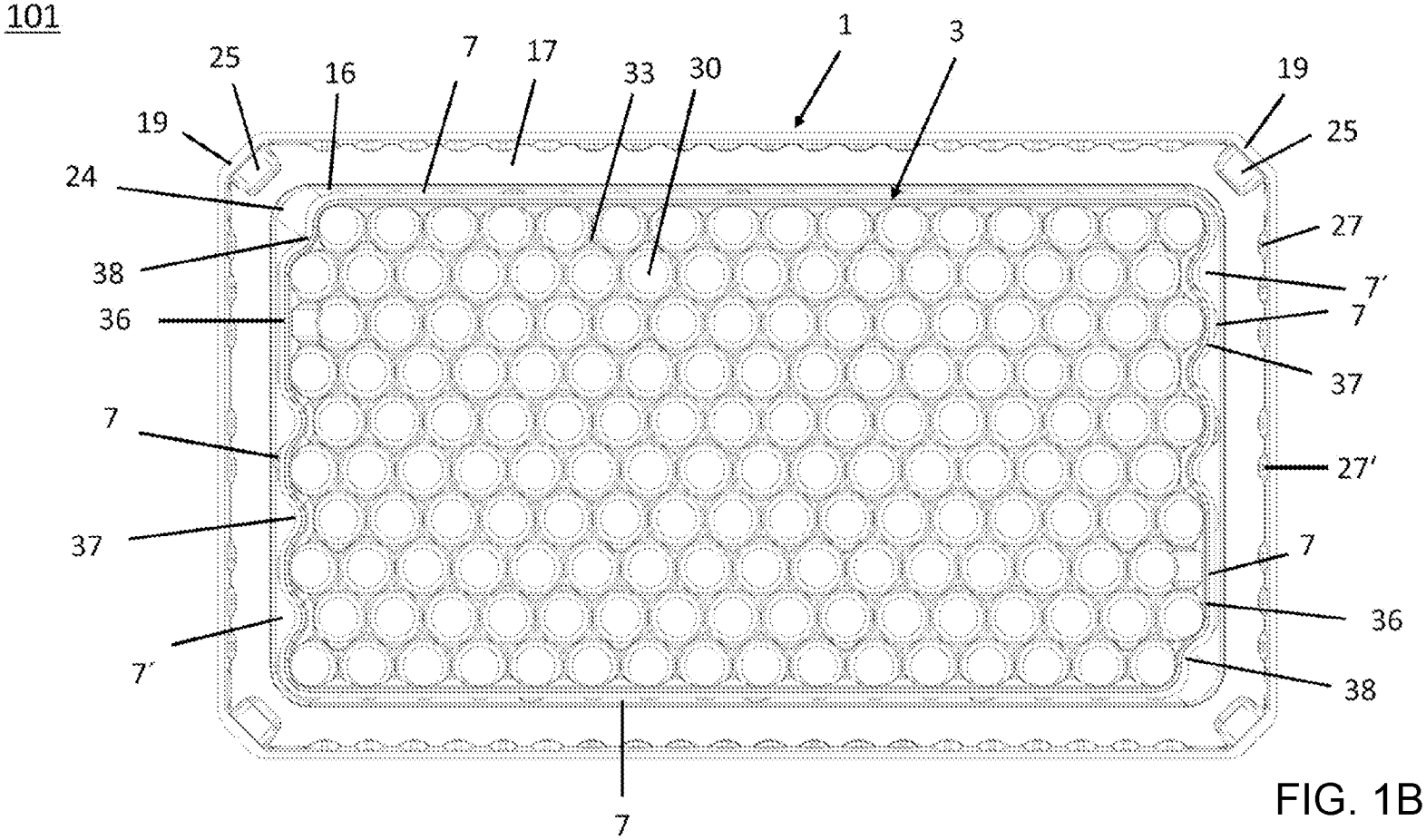
FIG. 1B illustrates the transport unit of FIG. 1A in a plan view from above.
Figure 1C:
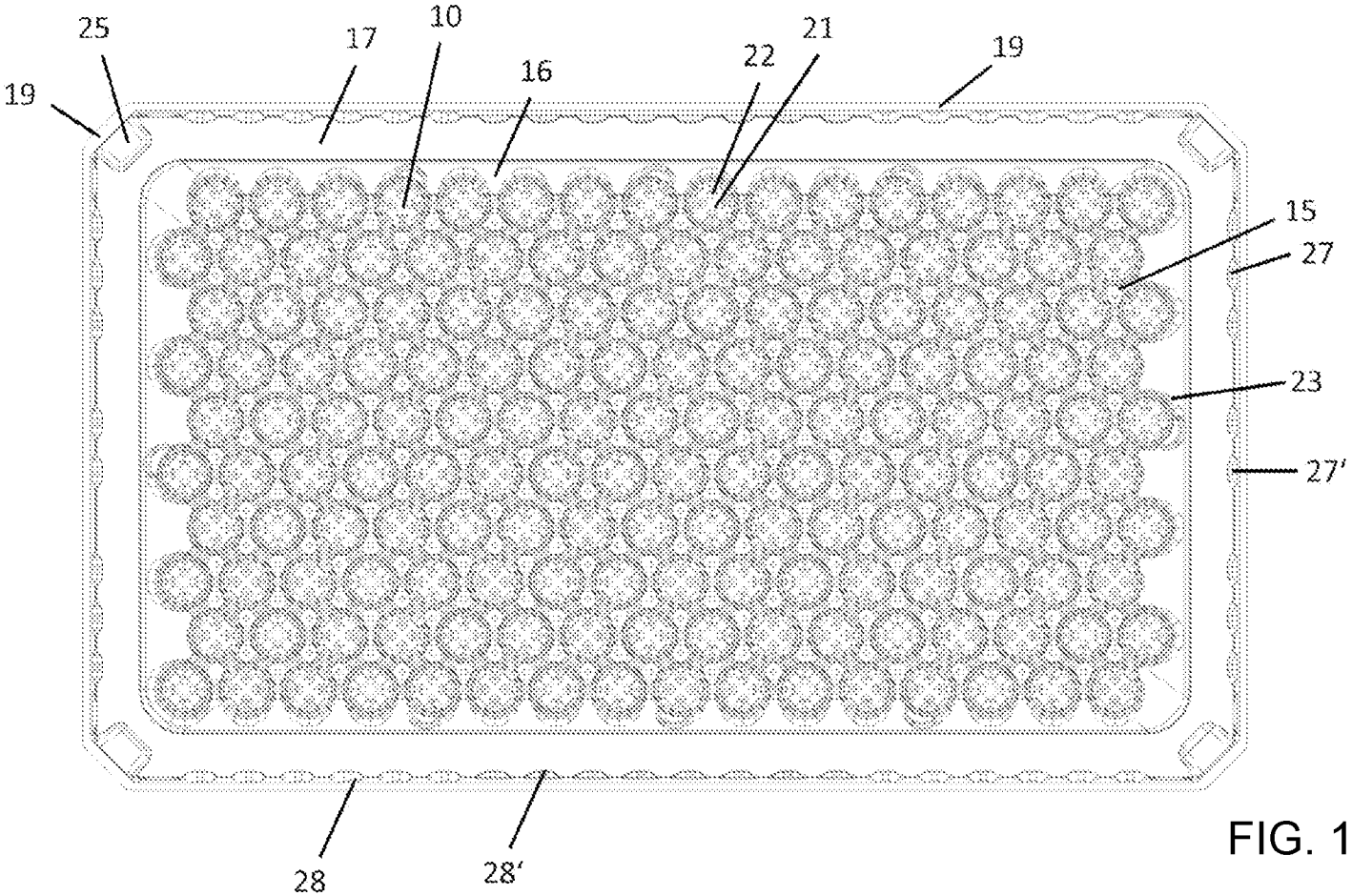
FIG. 1C illustrates the transport unit of FIG. 1A in a plan view from below.
Figure 1D:
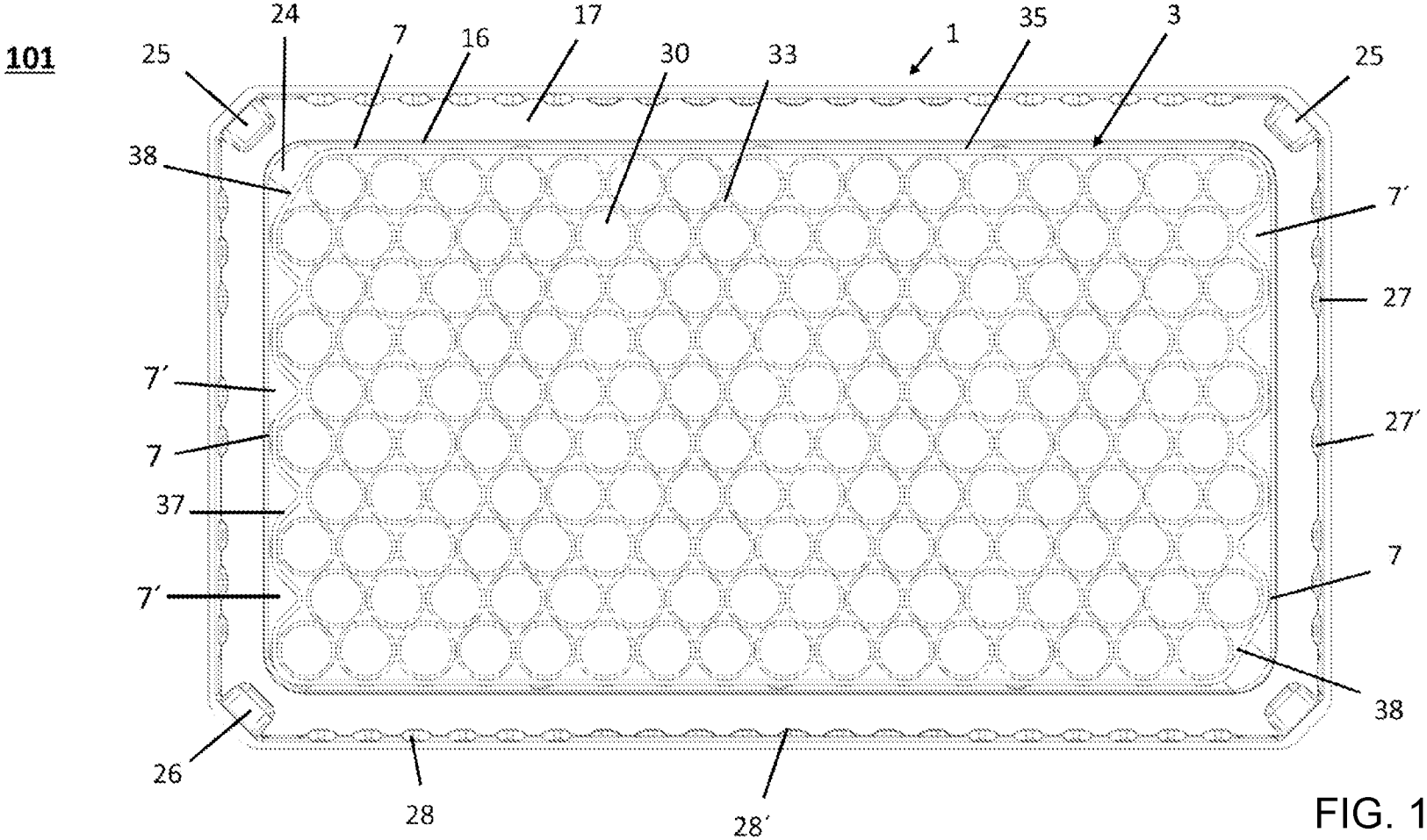
FIG. 1D illustrates a plan view from above of an exemplary embodiment of a transport unit of a packaging structure provided according to the present invention.

As can also be seen from FIGS. 1A and 1B, a plurality of first projections or depressions 28 and/or a plurality of second projections or depressions 28' are formed on the upper side wall 18 along a longitudinal side of the tray 1 or along two mutually opposite longitudinal sides of the tray 1, in order to permit detection of the orientation of the tray by sensors, in particular optoelectronic sensors. The first projections or depressions 28 are formed differently than the second projections or depressions 28', such that the orientation or position can be detected unambiguously.

Moreover, a plurality of first projections or depressions 27 and/or a plurality of second projections or depressions 27' are formed on the upper side wall along a transverse side of the tray 1 or along two mutually opposite transverse sides of the tray 1, in order to permit detection of the orientation or position of the tray by sensors, in particular optoelectronic sensors. The first projections or depressions 27 are formed differently than the second projections or depressions 27', such that the orientation or position can be detected unambiguously.

In some embodiments, the aforementioned depressions 27, 27', 28, 28' or projections do not extend down to the circumferentially formed extension 19 at the lower edge of the upper side wall 18, so that a continuous flat surface is available which can be detected by sensors and along which a gripper can move to section 25. Thereby a cover film, as described in more detail further herein, can be removed with a robot or similar device. Continuous surfaces on the outside of the upper side wall 18 thus represent an important feature for automatic removal of the cover film.

As can also be seen from FIGS. 1A and 1B, at least one set-back portion 25 is formed along the upper edge 17 of the tray 1, which set-back portion 25 forms a rectangular hollow space in the upper side wall 18 and the upper edge 17. When a cover film 5 is affixed to the upper edge 17 (cf. FIG. 2C), it can be easily gripped by hand or by a gripping tool in the region of the respective hollow space, in order to be pulled off completely from the upper edge 17. According to FIG. 1A, the set-back portions 25 may each be formed in the corner regions of the tray 1. They may be of sufficient size such that a finger of a human operator or a gripping tool can grip the cover film 5 over the hollow space and then pull it off.

FIG. 1A shows the aforementioned U-shaped free space 20 between the downwardly extending upper side wall 18 and the upper end of the side walls 16 of the tray 1.

Further details of the seats 10 of an exemplary embodiment of a tray 1 provided according to the present invention are described below with reference to FIGS. 1A to 2B, in which axial ribs 23 can be provided on the side walls of the seats 10. The axial ribs 23 can clearly be seen, distributed at uniform angle distances from each other along the seats 10. They serve in particular to further stiffen the tray 1, such that the tray 1 can be produced from a relatively thin material. A minimum opening width between the ribs 23 may be slightly greater than a maximum external diameter at the upper end 66 of the containers that are to be received, so as to prevent the upper ends of the containers from becoming jammed in the seats 10 of the tray 1. In some embodiments, the minimum opening width between the ribs 23 is in the range of 0.5 mm to 15 mm, such as in the range of 2.5 mm to 13 mm or in the range of 4 mm to 10 mm, greater than the maximum external diameter at the upper end 66 of the containers that are to be received. It can be seen from FIG. 2A that the depressions 30 of the inlay part 3 are exactly flush with the seats 10 of the tray 1.

Both the tray 1 with its seats 10 and the inlay part 3 with its depressions 30 may be produced by deep-drawing or thermoforming from a thin plastic film or plastic sheet made of a thermoplastic material. The thickness of the plastic film or plastic sheet can in particular lie in the range of between 0.5 mm and 1.0 mm or 2.0 mm. The above-described axial ribs 23, which are provided in particular in the side walls 11, 12 of the seats 10 of the tray 1 (cf. FIG. 2B), serve to stiffen the thin material of the tray 1, such that sufficient mechanical stability can also be ensured for thin materials.

The steps of a procedure for removing the containers from a packaging structure provided according to the present invention and for further processing of the containers are described below with reference to FIG. 3.

Firstly, a packaging structure with the containers received therein is made available. For this purpose, the packaging structure can already be transferred to a clean room if the packaging structure was already sealed off in a sterile manner with respect to the environment.

Subsequently in step S1, the cover film is then gripped and pulled away from the upper edge of the tray. To release the adhesive connection between cover film and upper edge, it is possible for heat to act in particular in this region in order to soften the adhesive connection. If, instead of a cover film, another cover is provided, the latter is correspondingly detached from the upper edge of the tray and removed in step S1. At the end of step S1, all of the containers in the tray are still covered, such that entry of contaminants into the tray and into the containers received therein is also still reliably prevented.

Thereafter, in step S2, the inlay part is lifted away from the containers and removed. For this purpose, the inlay part can be gripped in particular in the region of an indentation 38 (cf. FIG. 1B), which can also be done by the fingers of a human operator. At the end of step S2, the containers in the tray are no longer covered. However, since the containers at this stage are still received upside down in the seats of the tray, the filling openings of the containers are also still not easily accessible, such that entry of contaminants into the containers is also still reliably prevented.

The tray 1, together with the containers received in it, is then turned in step S3, such that the containers are finally placed upright and vertically on a work surface for their further processing. For the turning procedure, a rectangular holding frame can firstly be introduced into the U-shaped free space 20 below the upper edge 17 of the tray (cf. FIG. 1A). A turning plate can then be inserted from above into the tray until it comes into contact with the bases of the containers received in the tray. Finally, the holding frame can be turned together with the turning plate. The tray is guided by the holding frame, such that there is no displacement of the tray, and of the containers received therein, relative to the turning plate. At the end of step S3, the turning plate serves temporarily as a work surface for the further processing of the containers. Then, for their further processing, the containers can be pushed onto a further work surface provided downstream or can be transported away by a conveyor device, for example a belt conveyor.

As an alternative to lifting the inlay part in step S2, the removal of the inlay part can also in principle be dispensed with before the tray is turned together with the containers and the inlay part. This would allow further processing of the containers "in" the inlay part, thus in the same arrangement as in the tray, only with the filling openings facing upwards. This is, for example, advantageous for filling, since several parallel filling needles can be used, as with a nest solution. The positioning of the containers in the inlay part can be stabilized particularly advantageously if the lower ends of the containers are received with relatively little radial play in the depressions of the inlay part. For this purpose, the depressions of the inlay part can be sufficiently raised.

Of course, in an alternative to the above-described turning procedure, the containers received upside down in the seats of the tray can also be removed individually from the tray in step S3 and turned for further processing, e.g. with the aid of a robot or the like.

Following the turning procedure of step S3, the tray in step S4 is lifted vertically upward, from the containers placed on the turning plate, and removed. Following step S4, the containers are made available for their further processing in step S6. In this state, the containers are initially oriented vertically and upright.

For the further processing in step S6, the containers in step S5 can be transported to subsequent processing stations. The further processing in step S6 can in particular involve one or more of the following process steps: cleaning the containers, sterilizing the containers, drying the containers, filling the containers with at least one substance for pharmaceutical, medical or cosmetic uses, in particular with a liquid or solid pharmaceutical substance, introducing a protective gas atmosphere into the containers, closing the containers with stoppers or comparable closing elements, crimping a metal cap onto an applied stopper or closure element, labelling the containers.

After the turning in step S3 and after the removal of the tray in step S4, the containers are initially arranged spaced apart from each other on the turning plate or work surface. Thus, collisions between adjacent containers are still also reliably prevented, such that, even during the further processing of the containers, the formation of abrasions or unwanted scratches on the outer surfaces of the containers, even an undesired breakage of containers, is reliably prevented.

Figure 3:
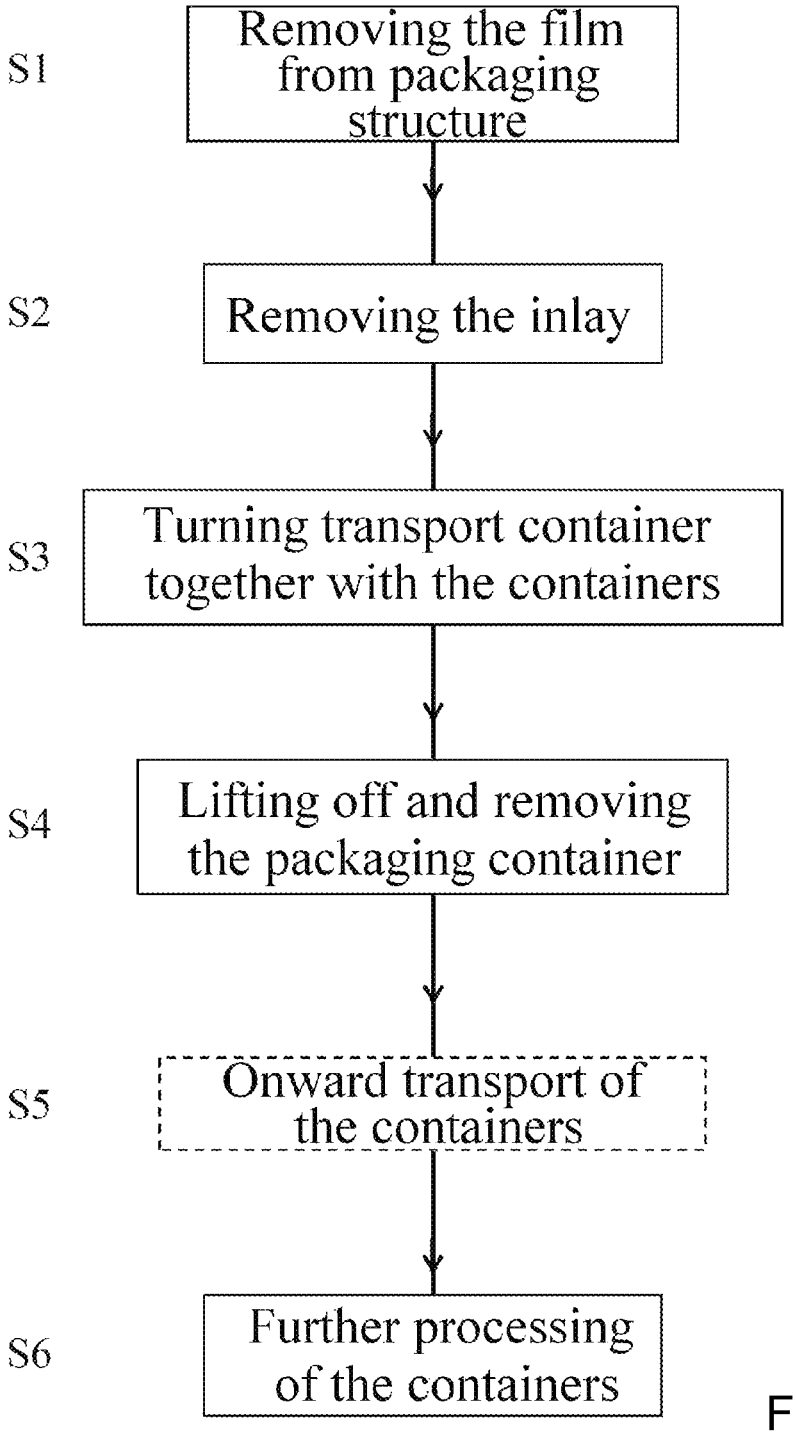
FIG. 3 illustrates a schematic flow chart that outlines the steps of a procedure for opening a packaging structure provided according to the present invention and for further processing the containers received therein.

As will be immediately apparent to a person skilled in the art when studying the above description, a packaging structure provided according to the present invention can be loaded with containers and then closed and sealed in a sterile manner by carrying out the steps according to FIG. 3 in reverse order.

As will be immediately apparent to a person skilled in the art when studying the above description, the main elements of a transport unit within the meaning of the present invention can be formed easily and cost-effectively, in particular by deep-drawing from a thin plastic film or plastic sheet of comparatively small thickness. This applies in particular to the above-described tray with the plurality of seats, which is formed in one piece. Even when the side walls 11, 12 of the seats 10 (cf. FIG. 2C) extend obliquely and radially inwards, the seats 10 provided according to the present invention can be arranged very close to each other, since according to the present invention they do not have to extend over the full height of the tray, and instead it suffices if they are formed only with a comparatively small height in the lower region of the tray. In this way, a very high packing density can be achieved according to the present invention. However, through the cooperation of the seats with the depressions of the inlay part, it is possible to achieve a very precise and stable positioning of the containers at their two ends, when they are received in the tray. According to the present invention, the containers can be held substantially immovably between the seats of the tray and the depressions of the inlay part.

Thus, collisions between directly adjacent containers inside the packaging structure are at all times reliably prevented, as well as during the opening or closing of the packaging structure and also during the insertion or removal of the containers, such that contamination resulting from such collisions is also reliably prevented inside the packaging structure.

The geometry of tray and inlay part, respectively with comparatively shallow seats and depressions, is therefore eminently suitable for production by deep-forming from a thin plastic film or plastic sheet of comparatively small thickness.

Since the containers are received upside down in the seats of the tray and are completely covered by the inlay part even during the opening or closing of the packaging structure, unwanted entry of contaminants into the containers can be largely avoided.

Since the filling openings of the containers are arranged spaced apart from the bases of the seats of the tray when the containers are received in the seats, and since according to the present invention a continuous gas flow path is ensured between the cover film and the upper free space 8*a* (cf. FIG. 2C) as far as the filling openings 67 of the containers 60, the containers 60 inside the packaging structure 100 can also be reliably sterilized, both on their outside and on their inside, by a gas or vapor flowing in through the cover film 5, which is affixed to the upper edge 17 of the tray 1, for example in the context of an ethylene oxide (EO) sterilization process.

The aforementioned continuous gas flow path is obtained in particular by the fact that, between the inlay part received in the tray and the side walls of the tray, a gap is at least partially formed via which the upper free space 8*a* (cf. FIG. 2C) communicates with the filling openings 67 of the containers 60.

The stability of the seats of the tray can be further increased if the side walls of the seats are provided with axial ribs. These also reduce the contact points between the containers and the side walls of the seats, which further reduces the danger of contaminants arising inside the packaging structure as a result of friction and abrasion.

A transport unit and a packaging structure provided according to the present invention thus afford many advantages together with a simple and cost-effective design.

As will be immediately apparent to a person skilled in the art when studying the above description, it is possible, instead of vials, for carpoules or comparable medicament containers of a cylindrical basic shape to be transported and stored in a packaging structure provided according to the present invention.

Carpoules also usually have a main body which is formed by a cylindrical side wall and which is adjoined by a tapered shoulder portion and a narrowed neck portion, the latter merging into a widened upper edge with a discharge opening formed therein, which discharge opening is usually closed by a stopper with a septum or the like which is axially secured on the upper edge with a crimped or flanged metal lid. At an opposite end of the carpoule, there is a filling opening for filling and for subsequently receiving a piston. The carpoules can be received in the same way upside down in the seats of the tray. In order as far as possible to prevent unwanted entry of contaminants into the carpoules via their filling openings, carpoules can alternatively also be received upright in the seats of the tray.

As will be immediately apparent to a person skilled in the art when studying the above description, a transport unit as described above, having the tray and the planar inlay part, can also be marketed on its own without containers received therein, and without a cover or a cover film placed onto the tray. However, a packaging structure provided according to the present invention may be marketed together with the containers received in the tray and with a cover or a cover film placed onto the tray, for example to manufacturers or fillers of pharmaceutical active substances. The containers may be stored in a sterile manner in the packaging structure and are immediately ready to use for further processing after the packaging structure is opened.

In principle, it is also conceivable for the main elements of a transport unit and of a packaging structure provided according to the present invention to be produced by a 3D printing method using a plastic. Thus, a further aspect of the present invention concerns a computer-readable or processor-readable file, also for transmission via networks such as an internal computer network or via the Internet, comprising instructions or commands which, when loaded by a computer or a processor, cause a 3D printer, controlled by the computer or processor, to print a holding structure, as disclosed in the present application, from a suitable material, in particular from a plastic material, in three-dimensional form.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE SIGNS

1 tray
3 inlay part
5 (sterile) cover film
7 gap
7' widened gap
8*a* upper free space
8*b* lower free space
10 seat
11 lower side wall
12 upper side wall
13 lower insertion bevel
14 upper insertion bevel
15 connecting portion
16 side wall
17 upper edge
18 upper side wall
19 circumferential extension
20 U-shaped free space
21 bottom of seat 10
22 bearing web
23 rib
24 rounded corner region
25 set-back portion of corner region 24
26 free space
27 first depressions at transverse side
27' second depressions at transverse side
28 first depressions at longitudinal side
28' second depressions at longitudinal side
29 space between bearing webs 22
30 seat
31 base of seat 30
32 side wall of seat 30
33 connecting portion
34 elevated edge
35 longitudinal side
36 straight edge portion at transverse side
37 undulating edge portion at transverse side
38 indentation
51 connecting region/adhesive edge
60 vial/container
62 cylindrical side wall
63 base
64 shoulder portion
65 narrowed neck portion
66 upper edge
77 filling opening
70 gap
71 gap
100 (sterile) packaging structure
101 transport unit
z1 height
z2 height
z3 height

What is claimed is:

1. A transport unit for a packaging structure for a plurality of containers for substances for pharmaceutical, medical or cosmetic uses, the transport unit comprising:

a tray with a plurality of seats configured to position containers; and a planar inlay part configured to cover the containers positioned in the seats of the tray and at the same time to be received completely in the tray without protruding above an upper edge of the tray, the inlay part having a plurality of depressions corresponding, in a one-to-one manner, to the seats of the tray formed therein, in order to position the containers at their two ends lying opposite each other, the plurality of depressions each having an absence of a through-hole, wherein a gap is formed at least partially between the inlay part received in the tray and side walls of the tray, the inlay part being configured to be received loosely with slight lateral play in the tray and thereby to form the gap.

2. The transport unit of claim 1, wherein the seats of the tray are arranged in a regular arrangement and are formed by circumferential side walls, of which a height is less than an axial length of the containers, and the depressions of the inlay part are formed by circumferential side walls of comparatively small height, such that, in a central height region between the tray and the inlay part, a free space is formed which is free of guiding or positioning devices for guiding or positioning the containers.

3. The transport unit of claim 2, wherein a height of the free space, which is free of guiding or positioning devices, is at least 40% of an overall height of the tray.

4. The transport unit of claim 2, wherein the circumferential side walls of the seats of the tray have a beveled configuration, wherein a minimum diameter of the seats of the tray is slightly greater than a maximum external diameter at an upper end of the containers that are to be received, so as to prevent the upper ends of the containers from becoming jammed in the seats of the tray.

5. The transport unit of claim 2, wherein a plurality of axial ribs are formed, at a distance from one another, on the circumferential side walls of the seats of the tray, which ribs protrude radially inwards into the seats, wherein a minimum opening width between the ribs is slightly greater than a maximum external diameter at upper ends of the containers that are to be received, so as to prevent the upper ends of the containers from becoming jammed in the seats of the tray.

6. The transport unit of claim 1, wherein the seats of the tray are of an overall cylindrical configuration, wherein at least two projections are formed on a base of a respective seat, on which projections of a widened upper edge of the respective container bears at a distance from the base, such that gas or vapor can flow into a filling opening of a container positioned in the seat.

7. The transport unit of claim 1, wherein circumferential side walls of the seats are adjoined by circumferential side walls which are of a beveled configuration in order to form frustoconical guide portions which are adapted to an outer contour of the containers to be received, in such a way that shoulder portions or cylindrical side walls of the containers are received with slight radial play.

8. The transport unit of claim 7, wherein further insertion bevels are formed at upper ends of the side walls of the frustoconical guide portions, wherein the upper ends of the side walls of adjacent seats are connected to each other via flat, annular connecting portions which collectively lie in one plane.

9. The transport unit of claim 1, wherein the depressions of the inlay part are formed by circumferential side walls, wherein a minimum diameter of the depressions of the inlay part is slightly greater than a maximum external diameter at a lower end of the containers that are to be received, so as to prevent the lower ends of the containers from becoming jammed in the depressions of the inlay part.

10. The transport unit of claim 1, wherein a free space is formed between the inlay part and the seats of the tray, the free space being free of guiding or positioning devices for guiding or positioning the containers.

11. The transport unit of claim 1, wherein at least one indentation is formed at an edge of the inlay part, wherein the edge of the inlay part is grippable in order to withdraw it from the tray.

12. The transport unit of claim 11, wherein the at least one indentation is formed in a corner region of the inlay part, and wherein corner regions of the tray are formed as rounded corner regions.

13. The transport unit of claim 1, wherein a plurality of portions with depressions or indentations are formed along an edge of the inlay part, wherein an outer contour of the inlay part is adapted to an inner contour of the tray, at its upper edge, such that the inlay part is received loosely and with slight lateral play in the tray when it bears on the containers positioned in the tray.

14. The transport unit of claim 13, wherein the edge of the inlay part runs in a straight line along longitudinal sides of the inlay part, and the plurality of portions with depressions or indentations are formed along a transverse side or along two mutually opposite transverse sides of the inlay part.

15. The transport unit of claim 1, wherein the upper edge of the tray is of a flat and circumferential form, and the upper edge is adjoined to an outside of an upper side wall which protrudes perpendicularly or substantially perpendicularly from the upper edge towards a lower end of the tray, in order to jointly form, with the upper edge and the inner side wall, a U-shaped and circumferential holding seat.

16. The transport unit of claim 15, wherein at least one of a plurality of first projections or depressions or a plurality of second projections or depressions are formed on the upper side wall along a transverse side of the tray or along two mutually opposite transverse sides of the tray, in order to permit detection of an orientation or position of the tray by sensors.

17. The transport unit of claim 15, wherein at least one of a plurality of first projections or depressions or a plurality of second projections or depressions are formed on the upper side wall along a longitudinal side of the tray or along two mutually opposite longitudinal sides of the tray, in order to permit detection of an orientation or position of the tray by sensors.

18. The transport unit of claim 1, wherein at least one set-back portion is formed along the upper edge of the tray, in order to permit gripping of a cover placed on the upper edge.

19. A packaging structure for containers for substances for pharmaceutical, medical or cosmetic uses, comprising:

a transport unit holding a plurality of containers, the transport unit comprising:

a tray with a plurality of seats in which the containers are positioned, the containers being received upside down in the seats of the tray; and a planar inlay part configured to cover the containers positioned in the seats of the tray and at the same time to be received completely in the tray without protruding above an upper edge of the tray, the inlay part having a plurality of depressions corresponding, in a one-to-one manner, to the seats of the tray formed therein, in order to position the containers at their two ends lying opposite each other, the plurality of depressions each having an absence of a through-hole, wherein a gap is formed at least partially between the inlay part received in the tray and side walls of the tray, the inlay part bearing on the containers positioned in the seats in such a way that the gap, which is narrow, is formed at least partially between the inlay part and side walls of the tray, the inlay part being configured to be received loosely with slight lateral play in the tray and thereby to form the gap; and a cover which is connected to an upper edge of the tray, the cover sealing off an inner volume of the packaging structure from the environment.

* * * * *